US007277106B2

(12) United States Patent
Ryu et al.

(10) Patent No.: US 7,277,106 B2
(45) Date of Patent: Oct. 2, 2007

(54) SCANNING APPARATUS HAVING A FLUORESCENT LAMP AND CONTROL METHOD THEREOF

(75) Inventors: Han-chung Ryu, Sungnam (KR); Jong-yang Choo, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 209 days.

(21) Appl. No.: 10/860,575

(22) Filed: Jun. 4, 2004

(65) Prior Publication Data

US 2005/0012468 A1 Jan. 20, 2005

Related U.S. Application Data

(63) Continuation-in-part of application No. 10/443,064, filed on May 22, 2003, now abandoned.

(30) Foreign Application Priority Data

Jul. 10, 2002 (KR) ..... 2002-40104

(51) Int. Cl.
*B41J 2/385* (2006.01)
*H05B 41/16* (2006.01)

(52) U.S. Cl. ..... 347/135; 347/128; 347/130; 347/129; 315/247; 315/224

(58) Field of Classification Search ..... 347/130, 347/132, 133, 128, 129, 135, 144, 142; 315/247, 315/246, 291, 307, 278, 279, 282, 209 R, 315/224

See application file for complete search history.

(56) References Cited

U.S. PATENT DOCUMENTS 4,988,920 A * 1/1991 Hoeksma ..... 315/101
5,270,823 A * 12/1993 Heidebroek et al. ..... 348/730
5,612,594 A 3/1997 Maheshwari ..... 315/224
5,914,871 A * 6/1999 Lin et al. ..... 363/131
6,222,325 B1 * 4/2001 Wuidart et al. ..... 315/209 R
6,414,447 B1 * 7/2002 Kitamura et al. ..... 315/272
6,546,132 B1 * 4/2003 Bhattacharjya et al. ..... 382/167
2002/0017897 A1 * 2/2002 Wilcox et al. ..... 323/282
2002/0121882 A1 * 9/2002 Matsuo et al. ..... 323/266

* cited by examiner

*Primary Examiner*—Tuyet Vo
(74) *Attorney, Agent, or Firm*—Staas & Halsey LLP

(57) ABSTRACT

A scanning apparatus having a cold cathode fluorescent lamp includes a central processing unit (CPU) controlling a scan unit to be in one of the stand-by mode, a scan mode and a sleep mode and outputting a PWM signal having a variable duty ratio based on an operation mode of the scan unit; a filter unit receiving the PWM signal from the CPU, filtering the PWM signal, and outputting the filtered signal; a feedback unit detecting the voltage applied to the fluorescent lamp and outputting a feedback signal; a controlling unit controlling the illumination of the fluorescent lamp based on the voltage input from the feedback unit, the controlling unit outputting a control signal variably controlling the voltage applied to the fluorescent lamp depending on the filtered signal; and a lamp drive unit applying variable AC voltage to the fluorescent lamp based on the control signal, thereby driving the fluorescent lamp. Accordingly, it is possible to control the luminous-intensity of the fluorescent lamp, reduce preheating time of the fluorescent lamp, extending the fluorescent lamp's lifetime, and lowering the power consumption.

25 Claims, 5 Drawing Sheets

SCANNING APPARATUS HAVING A FLUORESCENT LAMP AND CONTROL METHOD THEREOF

CROSS-REFERENCE TO RELATED APPLICATIONS

This application is a continuation-in-part of prior U.S. patent application No. 10/443,064 filed on May 22, 2003, now is abandoned. This application claims the benefit of Korean Patent Application No. 2002-40104, filed Jul. 10, 2002 in the Korean Intellectual Property Office, the disclosure of which is incorporated herein by reference.

BACKGROUND OF THE INVENTION

1. Field of the Invention

The present invention relates to a scanning apparatus employing therein an apparatus controlling a fluorescent lamp, and more particularly, to a scanning apparatus variably controlling a luminous intensity of a fluorescent lamp and a control method thereof.

2. Description of the Related Art

The cold cathode fluorescent lamp is widely utilized as a backlight source to illuminate the display panel of a liquid crystal display used as a display, such as in a portable notebook computer and the like, or as a light source constantly illuminating a manuscript in a scanning apparatus.

In order to drive a cold cathode fluorescent lamp mainly used in a scanning apparatus, it is common to generate a pulse wave through a switching device such as a transistor and to boost the generated pulse wave to a high voltage of more than 500 Vrms having a frequency equal to or above 200 KHz in a winding-type transformer applied to the cold cathode fluorescent lamp. The operation of the conventional fluorescent lamp controlling apparatus will be described with reference to FIG. 1, which shows a drive circuit of a fluorescent lamp used in a conventional scanning apparatus.

As shown in FIG. 1, according to the fluorescent lamp controlling apparatus, when the power supply switch S1 is turned on, a first transistor Q1 is activated by the voltage divided by a first resistor R1, a second resistor R2 and a third resistor R3, which form the voltage-dividing resistor. A first diode D1 and a first capacitor C1 protect the first transistor Q1 from counter electromotive force that is induced by a first inductor L1. The current output from the collector terminal of the first transistor Q1 is dropped to a predetermined voltage in a fourth resistor R4 and a fifth resistor R5 through the first inductor L1, and then the dropped voltage is applied to the respective base terminals of a second transistor Q2 and a third transistor Q3, and to the respective collector terminals of the second transistor Q2 and the third transistor Q3 through a second inductor L2 and a fourth inductor L4. A fifth inductor L5 is provided between the base terminals of the second transistor Q2 and the third transistor Q3, and hence only the single transistor begins to activate, resulting in the second transistor Q2 and the third transistor Q3 having an active state and a cut-off state that are alternatively iterated. The electromotive forces in opposite directions are alternatively generated in the second inductor L2 and the third inductor L3, respectively, and hence a secondary electromotive force of the high voltage having high frequency is generated in a third inductor L3 placed on the secondary side of transformer T1 which forms parallel-resonance with the second capacitor C2.

As described above, according to the conventional fluorescent lamp controlling apparatus, when the power supply switch S1 is turned on, a constant drive voltage is applied to the fluorescent lamp, whereas when the power supply switch S1 is turned off, the drive circuit is not operated and no drive voltage is applied to the fluorescent lamp. Consequently, the conventional fluorescent lamp controlling apparatus can not variably control the voltage applied to the fluorescent lamp and therefore, cannot adjust the luminous intensity of the fluorescent lamp for the respective operation modes of the scanning apparatus. Additionally, the conventional fluorescent lamp takes a long time to initially operate the fluorescent lamp because of the longer initial preheating time thereof, reducing the fluorescent lamp's lifetime, and causing higher power consumption.

SUMMARY OF THE INVENTION

Accordingly, the present invention has been made to solve the above-mentioned and/or other problems, and an aspect of the present invention is to provide a scanning apparatus having a fluorescent lamp of low power consumption therein and capable of prolonging the lifespan of the fluorescent lamp by variably applying electricity in accordance with the respective operation modes of the scanning apparatus, and a control method thereof.

In accordance with one aspect of the present invention, a scanning apparatus having a lamp irradiating a light onto a printing medium includes a central processing unit outputting a variable Pulse Width Modulated (PWM) signal in accordance with operation mode of the scanning apparatus, and a lamp control unit varying a voltage applied to the lamp in accordance with a ratio of the variable PWM signal and outputting the varied voltage.

According to another aspect of the present invention, the lamp control unit includes a filter unit removing noise from the PWM signal output from the central processing unit, and a drive unit outputting a varying a voltage applied to the lamp in accordance with the output from the filter unit.

According to another aspect of the present invention, the drive unit includes a feedback unit detecting a voltage applied to the lamp and outputting the detected voltage as a feedback signal, a controlling unit comparing the feedback signal output from the feedback unit with the signal output from the filter unit, and outputting a control signal for variable control, and a lamp drive unit outputting a varying voltage applied to the lamp in accordance with the output from the controlling unit.

According to another aspect of the present invention, the central processing unit may be operated in accordance with the user's selection or automatically by the timer, among a sleep mode, a scan mode and a stand-by mode, or among a copy mode, a scan mode and a fax mode. The central processing unit may be operated to output a variable PWM signal in accordance with the resolution of scanning. The scan mode refers to the scan mode using external device such as computer.

In accordance with another aspect of the present invention, a control method of a scanning apparatus which has a lamp for irradiating a light onto a printing medium, includes a PWM signal output operation in which a central processing unit outputs a variable PWM signal in accordance with operation mode of the scanning apparatus, and a voltage output operation in which a voltage applied to the lamp is varied in accordance with a ratio of the variable PWM signal and outputted.

According to another aspect of the present invention, the voltage outputting operation includes a filtering operation in which the PWM signal output from the central processing unit is filtered and output as a filtered signal, and a varied voltage output operation in which a voltage applied to the lamp is varied in accordance with the output from the filtering operation and output.

According to another aspect of the present invention, the varied voltage output operation includes a feedback signal output operation in which a voltage applied to the lamp is detected and output as a feedback signal, a control signal output operation in which the feedback signal output from the feedback unit is compared with the signal output from the filter unit, and a control signal is output of variable control, and a operation in which a voltage applied to the lamp is varied in accordance with the control signal and output.

According to another aspect of the present invention, the central processing unit may be operated in accordance with the user's selection or automatically by the timer, among a sleep mode, a scan mode and a stand-by mode, or among a copy mode, a scan mode and a fax mode. The central processing unit may be operated to output a variable PWM signal in accordance with the resolution of scanning. The scan mode refers to the scan mode using an external device such as computer.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects, features and advantages of the invention will become apparent and more readily appreciated from the following description of the embodiments, taken in conjunction with the accompanying drawings of which.

DETAILED DESCRIPTION OF THE EMBODIMENTS

Figure 1:
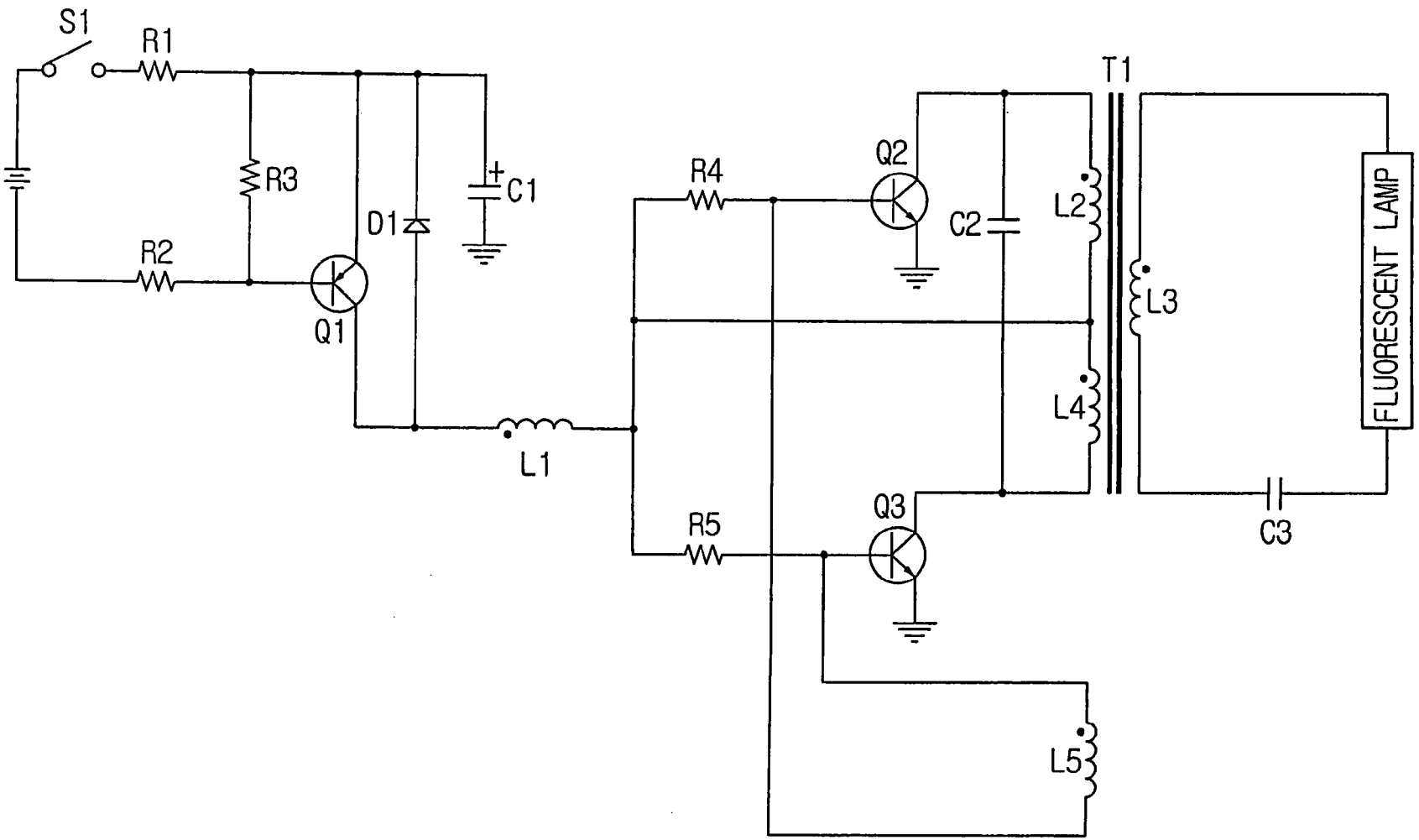
FIG. 1 (PRIOR ART)
FIG. 1 is a circuit diagram illustrating a conventional fluorescent lamp drive circuit.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Hereinafter, the description will be made as to an embodiment of the present invention with reference to FIG. 2. In the following description of the present invention, a detailed description of known functions and configurations incorporated herein will be omitted when it may make the subject matter of the present invention rather unclear.

Figure 2:
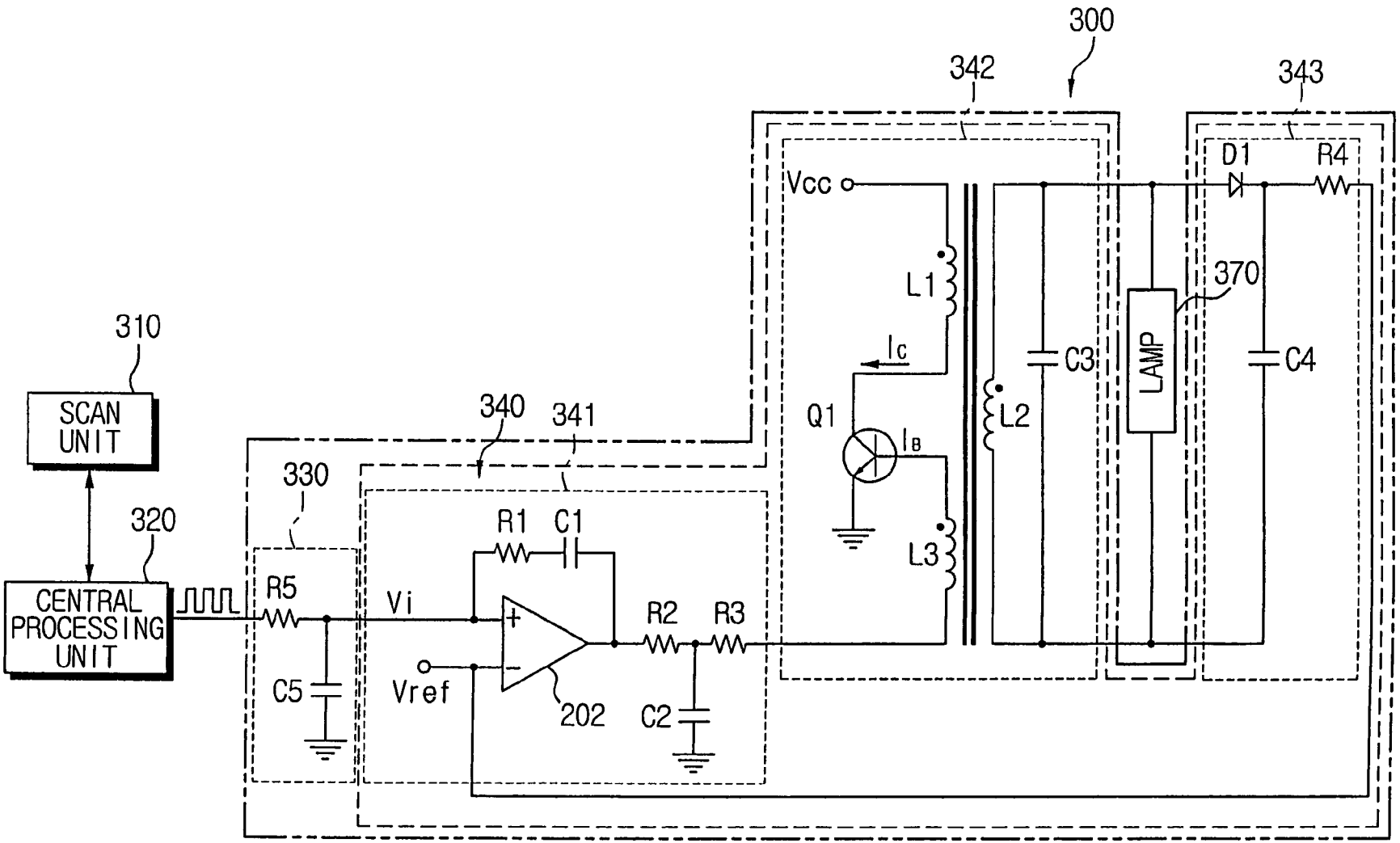
FIG. 2 is a circuit diagram illustrating a scanning apparatus having a fluorescent lamp according to an embodiment of the present invention.

FIG. 2 is a circuit diagram illustrating a scanning apparatus having a fluorescent lamp according to an embodiment of the present invention.

As shown in FIG. 2, the scanning apparatus having the fluorescent lamp includes a scan unit 310, a central processing unit (CPU) 320, a fluorescent lamp 370 and a lamp control unit 300.

The CPU 320 may control the scan unit 310 in accordance with an operation mode which is automatically selected by a user selection or a timer, and output a PWM signal such as a square wave signal, having a varying duty ratio according to the operation mode. The selected operation mode of the scanning apparatus includes a stand-by mode, a scan mode and a sleep mode. In addition to the operation modes, the scanning apparatus can also operate in accordance with one of a copy mode, a scan mode and a fax mode. The CPU 320 is constructed to output a PWM signal such as a square wave signal, having varying duty ratio according to the resolution of the scanning. The resolution of the scanning includes a text mode, a photo mode and a mixed mode.

The scan unit 310 includes the scanning apparatus, excluding the lamp control unit 300 and the fluorescent lamp 370. The scan unit 310 may operate in accordance with the operation mode control signal of the CPU 320.

The lamp control unit 300 includes a filter unit 330 and a drive unit 340. The lamp control unit 300 may vary the voltage supply to the fluorescent lamp 370 in accordance with the ratio of the PWM signal output from the CPU 320 and output the varied voltage. The filter unit 330 receives an input of PWM signal such as a square wave signal from the CPU 320, removes abnormal noise from the square wave signal and outputs the resultant signal to the drive unit 340. The drive unit 340 varies the voltage supply to the fluorescent lamp 370 in accordance with the output from the filter unit 330, and outputs the varied voltage. The drive unit 340 includes a controlling unit 341, a lamp drive unit 342 and a feedback unit 343. The feedback unit 343 detects the voltage applied to the fluorescent lamp 370 and feedbacks the detected voltage to the controlling unit 341. The controlling unit 341 receives the signal, from which the abnormal noise is removed, from the filter unit 330, compares the received signal with the voltage input from the feedback unit 343 and outputs a control signal to drive the lamp drive unit 342. The lamp drive unit 342 supplies variable voltage to the fluorescent lamp 370 based on the control signal that is input from the controlling unit 341, thereby driving the fluorescent lamp 370.

When the scan unit 310 is provided with power, the CPU 320 controls the apparatus so that the scan unit 310 can be quickly switched to the scan mode when the CPU 320 issues the scan command. That is, the CPU 320 controls the apparatus such that the fluorescent lamp 370 can be preheated for a short period of time by a square wave signal having a certain duty ratio such as 90% after the output of a PWM signal such as a square wave signal, having a large duty ratio such as 90%, or the output of PWM signal such as square wave signal, having incrementing duty ratio in a certain range such as a range from 0% to 90%.

If the CPU 320 issues a scan command as a result of an input from an external device while the scan unit 310 is in one of the sleep mode or the stand-by mode, the CPU 320 outputs the square wave signal having a certain duty ratio (for example, 90%) for a certain short time so that the lamp drive unit 342 can apply a maximum level of voltage to the fluorescent lamp 370. This results in rapidly preheating the fluorescent lamp 370. Alternatively, in order to prevent the excess current from flowing through the fluorescent lamp 370 when the fluorescent lamp 370 is at a low temperature and low impedance, the CPU 320 may first output a square wave signal with gradually increasing duty ratio within a predetermined range (for example, from 0% to 90%), and then output a square wave signal having a certain duty ratio (for example, 90%) for a certain short time so that the fluorescent lamp 370 can be preheated. Thereafter, the CPU 320 controls the scan unit 310 to be in the scan mode, and outputs the PWM signal such as the square wave signal having a certain duty ratio (for example, 50%) while the scan unit 310 performs the scanning operation. The certain duty ratio needs to be high enough to cause the fluorescent lamp 370 to stably emit the light in a constant amount.

If the scanning operation of the scan unit 310 is completed, or a first predetermined time has elapsed, the CPU 320 controls the scan unit 310 to be in the stand-by mode (for example, with duty ratio 30%). The first predetermined time may either be selected by the operator, or automatically set to the timer.

Also, if the CPU 320 is not provided with an externally input scan command for a second predetermined time while controlling the scan unit 310 to be in the stand-by mode, the CPU directs the scan unit 310 to go to the sleep mode (for example, to below duty ratio 10%), thereby minimizing the power consumption of the scan unit.

A fifth resistor R5 and a fifth capacitor C5 of the filter unit 330 remove abnormal noise from the PWM signal such as square wave signal output from the CPU 320, and output the resultant signal to the controlling unit 341.

The feedback unit 343 detects the voltage applied to the fluorescent lamp 370, and outputs the detected voltage as a feedback signal to the controlling unit 341. Since a first diode D1 and a fourth capacitor C4 of the feedback unit 343 are connected in series between the output terminal of the lamp drive unit 342 and a ground terminal, the rectified voltage is output from the junction of the first diode D1 and the fourth capacitor C4 and a fourth resistor R4 outputs the output high voltage as a dropped voltage feedback signal to the controlling unit 341.

The controlling unit 341 uses a reference voltage source generating a predetermined DC voltage ($V_{ref}$). Also, the controlling unit 341 includes an error amplifier 202 that has an inverting terminal receiving a first input voltage and a non-inverting terminal receiving a luminous-intensity adjusting signal externally input as a second input voltage, amplifies the voltage difference of the second and first input voltages, and outputs the amplified voltage difference. The first input voltage is the summation of the voltage output from the feedback unit 343 and the reference voltage output from the reference voltage source. A first resistor R1 and a first capacitor C1 of the controlling unit 341 are connected in series between the output terminal of the error amplifier 202 and the non-inverting terminal thereof, thereby canceling out the oscillation components of the voltage output from the error amplifier 202. Also, a second rersistor R2 and a second capacitor C2 of the controlling unit 341 are connected in series between the output terminal of the error amplifier 202 and the ground terminal, thereby rectifying the ripple voltage of the voltage that is output from the error amplifier 202. A third resistor R3 limits the amount of current that is rectified and output, and outputs the limited current to the lamp drive unit 342.

The PWM signal output from the CPU 320 is removed of abnormal noise at the filter unit 330, transformed into a certain level voltage at the drive unit 340, removed of ripple voltage and input to lamp drive unit 342 as a final PWM signal.

The lamp drive unit 342 variably drives the luminous-intensity of the fluorescent lamp 370 based on a signal that is input from the controlling unit 341. A first inductor L1 of the lamp drive unit 342 is provided between a power supply source supplying a given DC voltage and the collector terminal C of a first transistor Q1. The first transistor Q1 of the lamp drive unit 342 is activated by receiving DC current input from the controlling unit 341 at the first transistor's Q1 base terminal B, thereby flowing current through the first inductor L1 that is connected as a load to the collector terminal C. If the amount of current flowing through the first inductor L1 gradually increases and generates primary electromotive force, and thereafter the amount of current flowing through the first inductor L1 exceeds the saturation current amount (the current amplification factor $h_{FE}$ for the base current $I_B$ of the first transistor Q1), the first transistor Q1 enters into a cut-off state, cutting off the current flowing through the first inductor L1. Thus, the first transistor Q1 repeats in a given period the switching operation that generates forward and backward electromotive forces in the first inductor L1. And, a third inductor L3 is provided between the base input terminal of the first transistor Q1 and a third resistor R3 of the controlling unit 341 and provides the electromotive force having the same direction as that of the first inductor, thereby boosting the forward and backward bias voltages that are applied to the first transistor Q1. A second inductor L2 of the lamp drive unit 342 generates secondary electromotive force that is induced by the primary electromotive force generated from the first inductor L1 and is boosted by a given multiple. A third capacitor C3 is connected in parallel between the output terminal of the second inductor L2 and the ground terminal and forms resonance with a certain resonant frequency, thereby applying the high voltage having higher frequency generated in the second inductor L2 to the fluorescent lamp 370.

Figure 3A:
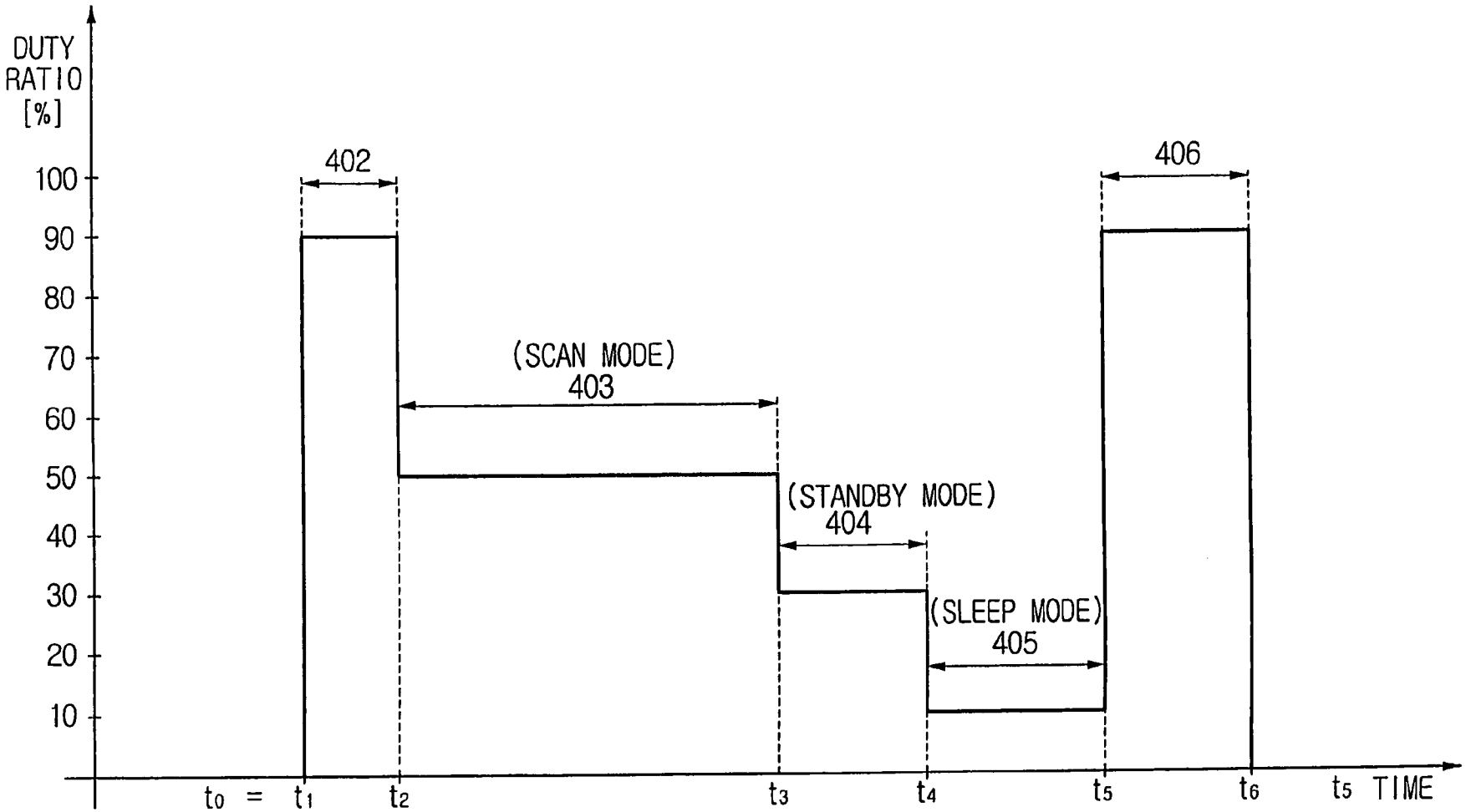
FIGS. 3A and 3B are sketches representing the duty ratio as a function of time of the pulse signal that is applied to the fluorescent lamp controlling apparatus in response to the respective operation modes of the scan unit shown in FIG. 2.
Figure 3B:
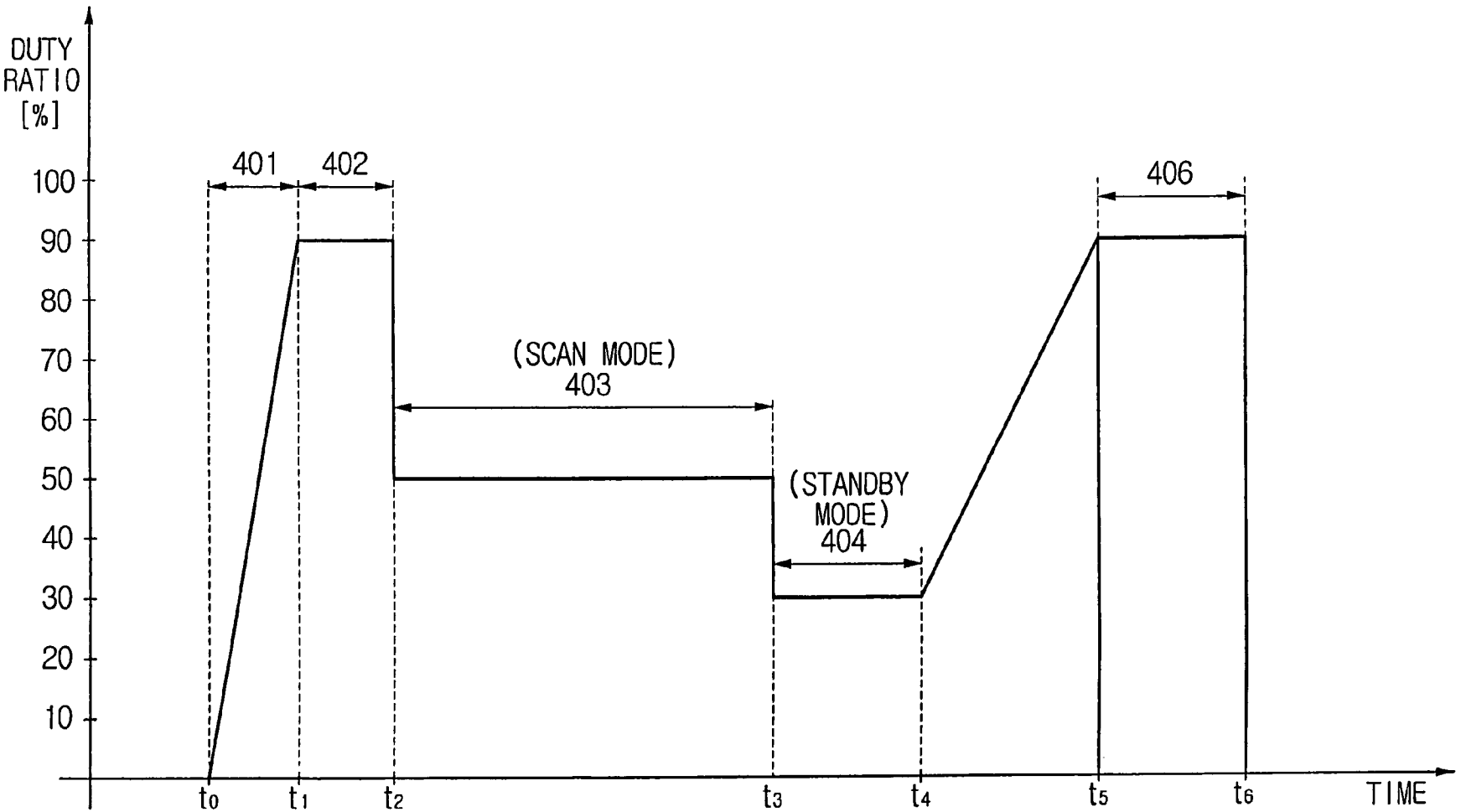

The variations of the duty ratio of the PWM signal such as the square wave signal that is output from the CPU 320 in response to the respective operation modes of the scan unit 310 will be explained in detail by referring to FIGS. 3A and 3B. FIGS. 3A and 3B illustrate the duty ratio as a function of time of the pulse signal that is applied to the apparatus controlling the fluorescent lamp in response to the respective operation modes of the scan unit shown in FIG. 2.

In an initial state, as the scan unit 310 is provided with power, the CPU 320 outputs a PWM signal having large duty ratio, such as a square wave signal having duty ratio 90% during time interval ($t_0$=$t_1$) (FIG. 3A), or outputs a square wave signal with gradually increasing duty ratio from 0% to 90% preventing excess electric current during time interval 401 ($t_0$~$t_1$) (FIG. 3B). The CPU 320 maintains the duty ratio at 90% during a given time interval 402 ($t_1$~$t_2$), and outputs the square wave signal to the filter unit 330, thereby causing the lamp drive unit 342 to provide the fluorescent lamp 370 with the maximum voltage applicable thereto to rapidly preheat the fluorescent lamp 370. Thereafter, the CPU 320 controls the scan unit 310 to be in the scan mode and maintains the duty ratio of the square wave signal at 50% during time interval 403 ($t_2$~$t_3$) in which the scan unit 301 performs the scanning operation. As the scanning operation of the scan unit 310 is completed, or when a first predetermined time is elapsed, the CPU 320 controls the scan unit 310 to be in the stand-by mode 404 ($t_3$~$t_4$). It is preferred but not required that the duty ratio of the square wave signal be 30% in the stand-by mode 404 ($t_3$~$t_4$). When the CPU 320 does not receive an externally inputted scan command for a second predetermined time while the scan unit 310 is in the stand-by mode 404, the CPU 320 directs the scan unit 310 to be in the sleep mode 405. The CPU 320 repeats the operations performed in the time intervals 403, 404 or 405. Although not shown in the drawings, 't4' can be the time point when the CPU 320 receives scan command from the external device in the stand-by mode. When receiving the scan command from the external device, the CPU 320 also outputs a PWM signal having large duty ratio, such as a square wave signal having duty ratio 90%.

Referring to FIG. 3B, during the stand-by mode 404, beginning with the time $t_4$ when the CPU 320 receives an externally input scan command, the CPU 320 outputs square wave signal with gradually increasing duty ratio within a predetermined range (for example, from 30% to 90%) for the prevention of excess electric current (time interval $t_4$~$t_5$), and repeats the operation performed in the time intervals 406, 403 and 404. Although not shown in the drawings, instead of stand-by mode 404, the CPU 320 may receive an externally input scan command in any other mode, such as a sleep mode. In the sleep mode, when the CPU 320 receives an externally input scan command, the CPU 320 may also output square wave signal with gradually increasing duty ratio within a predetermined range (for example, from 10% to 90%) for the prevention of excess electric current.

The scanning apparatus capable of varying the voltage supply to the lamp using the PWM signal and outputting the varied signal according to the present invention, may include more than one function among the copy, fax and printer functions. In the scanning apparatus having copy and fax operation modes, for example, the duty ratio of the PWM signal may be varied in accordance with the respective modes such as scan mode, copy mode and fax mode, to vary the voltage supply to the lamp. Alternatively, the duty ratio of the PWM signal may vary in accordance with the resolution of the scanning.

Figure 4:
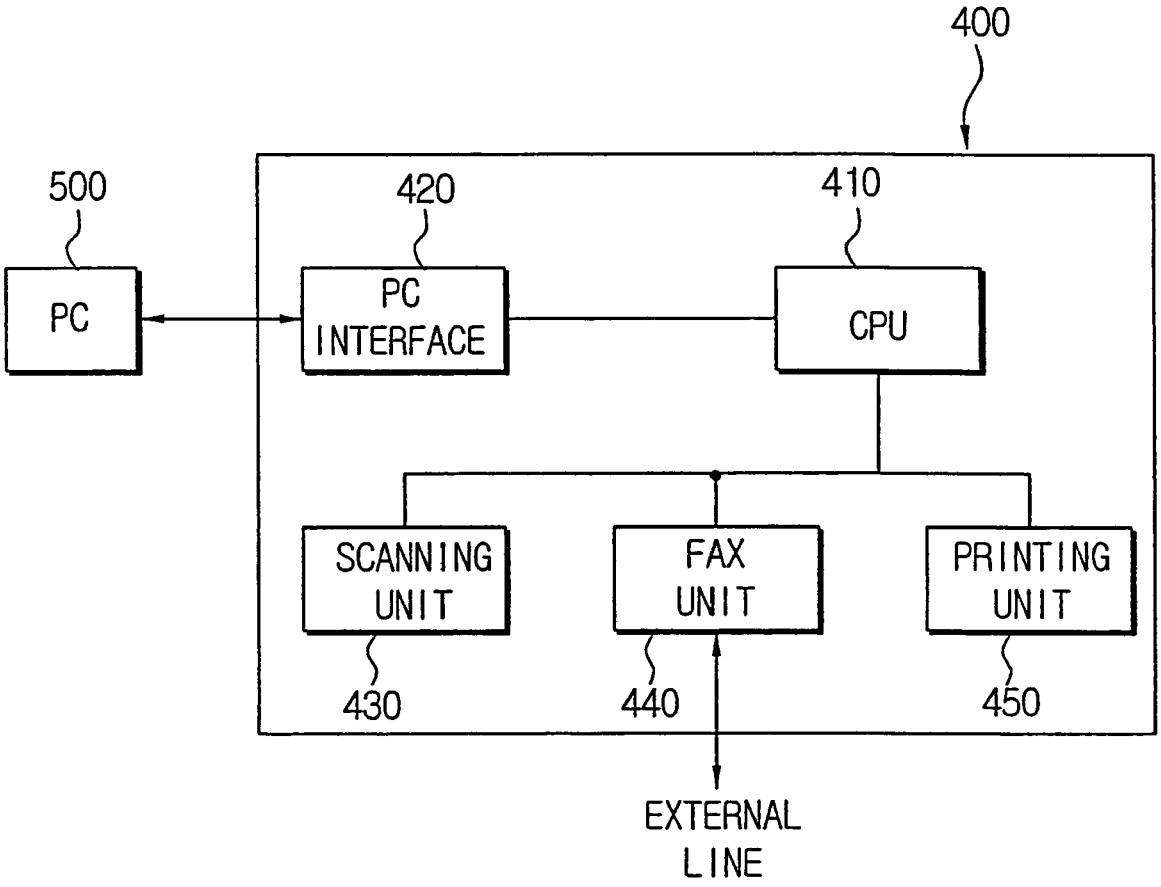
FIG. 4 (PRIOR ART)
FIG. 4 is a schematic block diagram of a general conventional scanning apparatus.

Meanwhile, if the scanning speed of the copy mode and the scan mode are compared, based on the assumption that the scanning resolution is identical, the scanning speed is slower during the scan mode. This is because the apparatus is interfaced with an external device such as computer and therefore, additional work is required to send scanned data to the external device. Because the scanning is slower during the scan mode, the lamp needs to be somewhat darker than in the copy mode. Accordingly, the level of voltage supplied to the lamp needs to be lowered. This will be briefly described with reference to the general scanning apparatus as shown in FIG. 4.

First of all, a general PC will be exemplified in the following explanation of an external device connected with the scanning apparatus. As shown in FIG. 4, the scanning apparatus 400 is connected to a PC 500 directing the scanning apparatus 400 to print or scan, a scan unit 430 scanning information on a printing medium in accordance with the scanning command received from the PC 500, a fax unit 440 including a line interface which receives and sends fax data through an external line during a fax mode, a printing unit 450 performing printing operation in accordance with the data transmitted from the fax unit and/or the printing command received from the PC 500, or if in the copy mode, receiving the scanned data from the scan unit 430 and performing corresponding printing operation, a CPU 410 generating a control signal to perform the respective modes such as a scan mode, a fax mode or a copy mode, and a PC interface unit 420 interfacing data input and output between the CPU 410 and the PC 500.

Scanning becomes slower in the scan mode than in the copy mode, because additional time is required for the storage of the data of the scanned printing medium and transmission with the external PC 500. The same energy is required for the scanning of the printing medium in both scan and copy modes. However, because scanning takes more time in the scan mode and the manuscript is exposed to the lamp light for a longer period of time, the light intensity needs to be lowered to meet the same energy requirement. If the copy mode and the fax mode are compared, the scanning speed at the same resolution is slower in the fax mode than in the copy mode. The fax mode also requires interfacing with the telephone line.

As described in the foregoing, it is possible to variably control the luminous-intensity of the fluorescent lamp 370 in accordance with the voltage level of the luminous intensity adjusting signal that is input to the controlling unit 341. The voltage that is applied to the fluorescent lamp 370 is more easily controlled by variably adjusting the duty ratio output from the CPU 320, and to preheat the fluorescent lamp 370 being at a low temperature and low impedance in the shortest time by increasing the duty ratio of the square wave signal that is output from the CPU 320, or linearly, or non-linearly increasing the duty ratio according to the characteristic of the fluorescent lamp 370.

In accordance with the scanning apparatus including the apparatus controlling the fluorescent lamp according to the present invention, it is possible to preheat the fluorescent lamp under low temperature and low impedance in the shortest time and to greatly extend the fluorescent lamp's lifetime by varying the voltage applied to the fluorescent lamp in accordance with the respective operation modes of the scanning apparatus, thereby reducing the power consumption.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A scanning apparatus having a lamp irradiating a light onto a printing medium and operating in at least one operation mode, comprising:

a central processing unit outputting a Pulse Width Modulated (PWM) signal having a variable duty ratio in accordance with the operation mode of the scanning apparatus; and a lamp control unit varying a voltage applied to the lamp in accordance with the duty ratio of the PWM signal and outputting the varied voltage, wherein the lamp control unit comprises:

a filter unit removing a noise from the variable signal output from the central processing unit; and a drive unit varying the voltage applied to the lamp in accordance with the output from the filter unit and outputting the varied voltage.

2. The scanning apparatus according to claim 1, wherein the operation mode of the scanning apparatus comprises at least one among a sleep mode, a scan mode and a stand-by mode.

3. The scanning apparatus according to claim 1, wherein the operation mode of the scanning apparatus comprises at least one among a copy mode, a scan mode and a fax mode.

4. The scanning apparatus according to claim 1, wherein the signal is a square wave signal.

5. The scanning apparatus according to claim 1, wherein the variable signal is a Pulse Width Modulated (PWM) signal.

6. The scanning apparatus according to claim 1, wherein the lamp is preheated under a low temperature and low impedance, extending the lamp's lifetime by varying the voltage applied to the lamp in accordance with the operation mode of the scanning apparatus, reducing power consumption.

7. The scanning apparatus according to claim 1, wherein the operation mode of the scanning apparatus is performed in accordance with a scanning resolution.

8. The scanning apparatus according to claim 7, wherein the scanning resolution varies in accordance with a text mode, a photo mode and a mixed mode.

9. The scanning apparatus according to claim 1, wherein the drive unit comprises a feedback unit detecting the voltage applied to the lamp and outputting the detected voltage as a feedback signal;

a controlling unit comparing the feedback signal output from the feedback unit with the signal output from the filter unit, and outputting a control signal for variable control; and a lamp drive unit varying the voltage applied to the lamp in accordance with the output from the controlling unit, and outputting the varied voltage.

10. The scanning apparatus according to claim 3, wherein the controlling unit receives a first input voltage and a second input voltage, amplifies a voltage difference between the first and second input voltages, and outputs the voltage difference to the lamp drive unit.

11. The scanning apparatus according to claim 10, wherein the first input voltage is a summation of the voltage output from the feedback unit and a reference voltage output from a reference voltage source.

12. The scanning apparatus according to claim 11, wherein the reference voltage is a DC voltage.

13. The scanning apparatus according to claim 9, wherein the controlling unit includes an amplifier having an inverting terminal receiving a first input voltage and a non-inverting terminal receiving a luminous-intensity adjusting signal externally input as a second input voltage, amplifies the voltage difference of the second and first input voltages, and outputs an amplified voltage difference.

14. The scanning apparatus according to claim 13, wherein a first resistor and a first capacitor of the controlling unit are connected in series between an output terminal of the amplifier and the non-inverting of the amplifier, canceling oscillation components of the output amplified voltage difference.

15. The scanning apparatus according to claim 14, wherein a second resistor and a second capacitor of the controlling unit are connected in series between the output terminal of the amplifier and a ground terminal, rectifying a ripple voltage of the output amplified voltage difference.

16. The scanning apparatus according to claim 15, wherein a third resistor limits an amount of current rectified and output by the amplifier, and outputs the limited current to the lamp drive unit.

17. A method of controlling a scanning apparatus having a lamp irradiating a light onto a printing medium and operating in at least one operation mode, the method comprising:

outputting a Pulse Width Modulation (PWM) signal having a variable duty ratio in accordance with the operation mode of the scanning apparatus; and varying the voltage applied to the lamp in accordance with the duty ratio of the PWM variable signal and outputting the varied voltage, wherein the varying the voltage comprises:

filtering the variable signal and outputting a filtered signal; and varying the voltage applied to the lamp in accordance with the filtered signal.

18. The method according to claim 17, wherein the varying the voltage comprises:

detecting the voltage applied to the lamp and outputting the detected voltage as a feedback signal;

comparing the feedback signal with the filtered signal, and outputting a control signal; and varying the voltage applied to the lamp in accordance with the output control signal.

19. The method according to claim 17, wherein the operation mode of the scanning apparatus comprises at least one among a sleep mode, a scan mode and a standby mode.

20. The method according to claim 17, wherein the operation mode of the scanning apparatus comprises at least one among a copy mode, a scan mode and a fax mode.

21. The method according to claim 17, wherein the variable signal is a Pulse Width Modulated (PWM) signal.

22. The method according to claim 17, wherein the variable signal is a square wave signal.

23. The method according to claim 17, wherein the lamp is preheated under a low temperature and low impedance, extending the lamp's lifetime by varying the voltage applied to the lamp in accordance with the operation mode of the scanning apparatus, reducing power consumption.

24. The method according to claim 17, wherein the operation mode of the scanning apparatus is performed in accordance with a scanning resolution.

25. The method according to claim 24, wherein the scanning resolution varies in accordance with a text mode, a photo mode and a mixed mode.

* * * * *

UNITED STATES PATENT AND TRADEMARK OFFICE

CERTIFICATE OF CORRECTION

PATENT NO. : 7,277,106 B2
APPLICATION NO. : 10/860575
DATED : October 2, 2007
INVENTOR(S) : Han-chung Ryu et al.

It is certified that error appears in the above-identified patent and that said Letters Patent is hereby corrected as shown below:

Column 10, Line 30, change “standby” to --stand-by--.

Signed and Sealed this

First Day of April, 2008

JON W. DUDAS
*Director of the United States Patent and Trademark Office*